US007833365B2

(12) United States Patent
Kitayama et al.

(10) Patent No.: US 7,833,365 B2
(45) Date of Patent: Nov. 16, 2010

(54) RARE EARTH COMPOUND CONTAINING GAS GENERATING COMPOSITION

(75) Inventors: Kenji Kitayama, Tatsuno (JP); Shogo Tomiyama, Tatsuno (JP)

(73) Assignee: Daicel Chemical Industries, Ltd., Sakai-shi Osaka (JP)

( * ) Notice: Subject to any disclaimer, the term of this patent is extended or adjusted under 35 U.S.C. 154(b) by 156 days.

(21) Appl. No.: 11/627,766

(22) Filed: Jan. 26, 2007

(65) Prior Publication Data

US 2007/0200090 A1 Aug. 30, 2007

Related U.S. Application Data

(60) Provisional application No. 60/763,917, filed on Feb. 1, 2006.

(30) Foreign Application Priority Data

Jan. 26, 2006 (JP) ..... 2006-17386

(51) Int. Cl.
*C06B 31/00* (2006.01)

(52) U.S. Cl. ..... 149/35; 149/45; 149/46; 149/61

(58) Field of Classification Search ..... 252/181.1, 252/181.6; 423/263; 149/35, 45, 46, 61
See application file for complete search history.

(56) References Cited

U.S. PATENT DOCUMENTS

| | | | | |
|---|---|---|---|---|
| 5,035,757 | A | 7/1991 | Poole | |
| 6,277,221 | B1 * | 8/2001 | Lundstrom | 149/45 |
| 6,328,906 | B1 | 12/2001 | Lundstrom et al. | |
| 6,416,599 | B1 * | 7/2002 | Yoshikawa et al. | 149/45 |
| 2005/0127324 | A1 | 6/2005 | Wu | |

FOREIGN PATENT DOCUMENTS

| | | | |
|---|---|---|---|
| EP | 0952131 | A1 | 10/1999 |
| JP | 11-510779 | A | 9/1999 |
| JP | 2000-517282 | A | 12/2000 |
| JP | 2001-508751 | A | 7/2001 |
| JP | 2002-512167 | A | 4/2002 |
| JP | 2002-519278 | A | 7/2002 |
| JP | 2003-525106 | A | 8/2003 |
| JP | 2003-529513 | A | 10/2003 |
| JP | 2005-126262 | A | 5/2005 |
| WO | WO-97/04860 | A2 | 2/1997 |
| WO | WO-98/06486 | A2 | 2/1998 |
| WO | WO-98/08782 | A1 | 3/1998 |
| WO | WO-99/30926 | A2 | 6/1999 |
| WO | WO-00/00365 | A2 | 1/2000 |
| WO | WO-00/39053 | A2 | 7/2000 |
| WO | WO-00-64839 | A2 | 11/2000 |
| WO | WO-01/34516 | A1 | 5/2001 |

* cited by examiner

*Primary Examiner*—Steven Bos
(74) *Attorney, Agent, or Firm*—Birch, Stewart, Kolasch & Birch, LLP.

(57) ABSTRACT

The present invention provides a gas generating composition comprising a light rare earth compound.

8 Claims, No Drawings

RARE EARTH COMPOUND CONTAINING GAS GENERATING COMPOSITION

This nonprovisional application claims priority under 35 U. S. C. §119(a) on Patent Application No. 2006-17386 filed in Japan on 26 Jan. 2006 and 35 U. S. C. §119(e) on U.S. Provisional Application No. 60/763917 filed on 1 Feb. 2006, which are incorporated by reference.

BACKGROUND OF INVENTION

1. Field of Invention

The present invention relates to a gas generating composition suitable for airbag restraint systems of automobiles or the like.

2. Description of Related Art

Gas generating agents typically generate a large amount of fine combustion residue and mist (solid components (for example, metal components) in the gas generating agent that are generated by combustion of the gas generating agent) after the combustion. Combustion residue that has been just generated bears heat. If the combustion residue is released into an air bag, the air bag is damaged and there is a risk of inflicting burns to a vehicle occupant. Further, if the airbag is damaged, the mist is released into the vehicle cabin. In order to avoid such danger, a fine-mesh metal filter is disposed inside an inflator.

However, because the filter has the highest weight ratio among the inflator components, although the filter purifies the gas, the use thereof causes the increase in weight and size of the inflator.

Decreasing the combustion temperature of the gas generating agent can be considered as a method for reducing the size and weight of the filter. JP-A No. 2003-525106 and JP-A No. 2005-126262 describes adding the components for decreasing the combustion temperature.

SUMMARY OF THE INVENTION

The present invention provides a gas generating composition including a light rare earth compound.

DETAILED DESCRIPTION OF INVENTION

The present invention provides a gas generating composition that purifies the gas by using a rare earth compound that is not described in JP-A No. 2003-525106 and JP-A No. 2005-126262 and generates hardly any mist during combustion.

The light rare earth compound is preferably a compound of a rare earth element selected from scandium, yttrium, lanthanum, cerium, praseodymium, and neodymium. The preferred light rare earth compound is selected from oxides, hydroxides, halogenides (halides), nitrates, sulfates, acetates, phosphates, and carbonates of rare earth elements. The light rare earth compound preferably has a mean particle size within a range of 0.5 to 500 μm.

The gas generating composition in accordance with the present invention generates but a small amount of carbon monoxide or nitrogen oxide during combustion and generates hardly any mist during combustion.

EMBODIMENTS OF INVENTION

The gas generating composition in accordance with the present invention includes a light rare earth compound. Other components can be selected from fuels, oxidizing agents, binders, and additives that are used in the known gas generating compositions. The light rare earth compound acts to decrease the generated amount of toxic nitrogen oxide and carbon monoxide after the combustion and also act to convert the generated mist into a slag residue inside the gas generator.

The light rare earth compound is a compound of a rare earth element selected from scandium, yttrium, lanthanum, cerium, praseodymium and neodymium. The compound can be selected from oxides, hydroxides, halogenides, nitrates, sulfates, acetates, phosphates, and carbonates of rare earth elements.

Among them, oxides and hydroxides of lanthanum, cerium, praseodymium, and neodymium are preferred.

The light rare earth compound preferably has a mean particle size within a range of 0.5 to 500 μm, more preferably within a range of 0.5 to 100 μm, and even more preferably within a range of 0.7 to 20 μm.

The mean particle size is measured by a particle size distribution method based on laser light scattering. The measurement sample is prepared by dispersing a basic metal nitrate in water and irradiating for three minutes with ultrasonic waves. Then, a 50% accumulated value ($D_{50}$) of the number of particles is found and the mean value obtained in two cycles of measurements is taken as a mean particle size.

The content of the rare earth compound in the gas generating composition is preferably 0.1 to 20 mass %, more preferably 0.5 to 15 mass %, and even more preferably 0.5 to 10 mass %.

At least one selected from among tetrazole compounds, guanidine compounds, triazine compounds, and nitroamine compounds can be used as the fuel.

The preferred tetrazole compounds include 5-aminotetrazole and bitetrazole ammonium salt. The preferred guanidine compounds are guanidine nitrate, aminoguanidine nitrate, nitroguanidine, and triaminoguanidine nitrate. The preferred triazine compounds are melamine, cyanuric acid, ammeline, ammelide, and ammeland. The preferred nitroamine compound is cyclo-1,3,5-trimethylene-2,4,6-trinitramine.

As the oxidizing agent, at least one selected from among basic metal nitrates, nitrates, ammonium nitrate, perchlorates, and chlorates can be used.

As basic metal nitrate, at least one selected from among basic copper nitrate, basic cobalt nitrate, basic zinc nitrate, basic manganese nitrate, basic iron nitrate, basic molybdenum nitrate, basic bismuth nitrate, and basic cerium nitrate can be used.

For the basic metal nitrate to increase the burning rate, the mean particle size thereof is preferably 30 μm or less, more preferably 10 μm or less. The mean particle size is measured by a particle size distribution method based on laser light scattering. The measurement sample is prepared by dispersing a basic metal nitrate in water and irradiating for three minutes with ultrasonic waves. Then, a 50% accumulated value ($D_{50}$) of the number of particles is found and the mean value obtained in two cycles of measurements is taken as a mean particle size.

Examples of the nitrate include alkali metal nitrates such as potassium nitrate and sodium nitrate and alkaline earth metal nitrates such as strontium nitrate.

Perchlorates and chlorates are compounds also producing both the oxidizing action and the combustion enhancing action. The oxidizing action means the action that efficiently advances combustion by generating oxygen during combustion and decreases the generation amount of toxic gases such as ammonia and carbon monoxide. On the other hand, the combustion enhancing action means the action that improves the ignition ability of the gas generating composition or increases the burning rate.

At least one selected from among ammonium perchlorate, potassium perchlorate, sodium perchlorate, potassium chlorate, and sodium chlorate can be used as the perchlorates and chlorates.

Examples of the binder include at least one selected from among carboxymethyl cellulose, carboxymethyl cellulose sodium salt, carboxymethyl cellulose potassium salt, carboxymethyl cellulose ammonium salt, cellulose acetate, cellulose acetate butyrate, methyl cellulose, ethyl cellulose, hydroxyethyl cellulose, ethylhydroxyethyl cellulose, hydroxypropyl cellulose, carboxymethylethyl cellulose, microcrystalline cellulose, polyacrylamide, polyacrylamide amino compound, polyacryl hydrazide, acrylamide-acrylic acid metal salt copolymers, polyacrylamide-polyacrylic acid ester compound copolymers, polyvinyl alcohol, acrylic rubber, guar gum, starch, and silicone.

Examples of the additive include at least one selected from among copper (for example, electrolytic copper powder), metal oxides such as copper oxide, iron oxide, zinc oxide, cobalt oxide, manganese oxide, molybdenum oxide, nickel oxide, bismuth oxide, silica, and alumina, metal carbonates and basic metal carbonates such as cobalt carbonate, calcium carbonate, basic zinc carbonate, and basic copper carbonate, complex compounds of metal oxides or hydroxides such as Japanese acid clay, kaolin, talc, bentonite, deatomaceous earth, and hydrotalcite, aluminum hydroxide, magnesium hydroxide, metallic acid salts such as sodium silicate, mica molybdenic acid salt, cobalt molybdate, and ammonium molybdate, molybdenum disulfide, calcium stearate, silicon nitride, and silicon carbide.

No specific limitation is placed on the contents of components other than the rare earth compound. For example, they can be selected within the range identical to that of an additive selected from among organic compounds as fuels, oxygen-containing oxidizing agents, binders, metal oxide, and metal carbonates as described in JP-A No. 2005-126262.

The gas generating composition in accordance with the present invention can be molded to any desired shape such as a single-perforated cylindrical shape, a porous cylindrical shape, or a pellet.

Such a molded article can be manufactured by adding water or an organic solvent to the gas generating composition, mixing them and extruding (in the case of a molded article having a single-perforated cylindrical shape or a porous cylindrical shape) or by compression-molding (by using a palletizer (in the case of molded article in the form of a pellet). In a molded article having a single-perforated cylindrical shape or a porous cylindrical shape, the hole can be either of a through hole which pierces in the longitudinal direction or a recess which does not pierce.

The gas generating composition in accordance with the present invention or a molded article obtained therefrom can be applied, for example, to an airbag inflator of a driver side, an airbag inflator for a passenger side next to a driver, a side airbag inflator, an inflatable curtain inflator, a knee bolster inflator, an inflatable seat belt inflator, a tubular system inflator, and a pretensioner gas generator of various vehicles.

The inflator using the gas generating composition in accordance with the present invention or a molded article obtained therefrom may be of a pyrotechinc type in which gas is supplied only from the gas generating agent, or of a hybrid type, gas is supplied from both the gas generating agent and a compressed gas such as argon.

Furthermore, the gas generating composition in accordance with the present invention or a molded article obtained therefrom can be also used as an ignition agent called an enhancer agent (or booster) for transmitting the energy of a detonator or squib to the gas generating agent.

When a gas generating agent burns during the actuation of the airbag gas generator, a mist (solid components, such as a metal component, included in the gas generating agent that are generated by combustion of the gas generating agent) is generated. If the generated amount of mist is large, the filter is heavily damaged and the mist that passed through the filter flows into the air bag. When this problem is solved by increasing the filter thickness (or increasing the bulk density thereof), the weight of the entire gas generator is increased and the demand for weight reduction cannot be met.

In the gas generating composition in accordance with the present invention, due to the action of the light rare earth compound that is a component thereof, mist generation is made difficult and the generated mist can be caused to remain inside the gas generator as a slag (residue) (the slag is a mist that was retained and solidified inside the gas generator, without passing through the filter). If the generation of mist is thus inhibited and the mist is caused to remain as the slag, the filter is prevented from being damaged by the mist, and the mist does not flow through the filter into the airbag. Therefore, the filter thickness or bulk density can be decreases. As a result, the air bag gas generator employing the gas generating composition in accordance with the present invention can be reduced in weight.

EXAMPLES

The present invention will be described below in greater detail based on Examples, but the present invention is not limited thereto.

Examples and Comparative Examples

A total of 5000 g of the components shown in Table 1 and 737 g of water were charged into a mixer and mixed. The mixture was extruded with an extruder, cut, and dried to obtain a gas generating composition in the form of a single-perforated pellet having an outer diameter of 3.8 mm, an inner diameter of 1.1 mm, and a length of 4.1 mm.

(Composition of Generated Gas)

A total of 2 g of the gas generating composition (powdered) including the components shown in Table 1 was used and molded to obtain a strand. The strand was attached to a tightly closed cylinder having an inner capacity of one liter, and the atmosphere inside the cylinder was replaced with nitrogen. Then, the inside of the cylinder was pressurized up to 6860 kPa with nitrogen, and the strand was ignited by passing an electric current via a nichrome wire to cause the complete combustion. In about twenty seconds after the electric current was passed, the combustion gas was sampled into a gas sampling bag, and the concentrations of NO, CO, and $NH_3$ (ppm; mass standard) was analyzed with a detection tube.

(Evaluation of Slag State)

A total of 2 g of the gas generating composition (powdered) including the components shown in Table 1 was used and molded to obtain a strand. The strand was attached to tightly closed cylinder having an inner capacity of one liter, and the atmosphere inside the cylinder was replaced with nitrogen. Then, the inside of the cylinder was pressurized up to 6860 kPa with nitrogen, and the strand was ignited by passing an electric current via a nichrome wire to cause complete combustion. Upon completion of combustion, the combustion residue (slag) was sampled and the state thereof was evaluated according to the following criteria.

○: has a lump-like shape and is not fractured when pressed with a finger.

Δ: has a lump-like shape, but is fractured when pressed with a finger.

X: has a powder shape.

(Measurement of Slag Amount)

The slag remaining inside the tightly sealed cylinder after the test for evaluating the slag state was sampled and sieved via a sieve having a mesh size of 3.3 mm. The mass of the slag remaining on the sieve was measured. A large amount of the slag remaining on the sieve means that the amount of mist that came into contact with the filter and passed therethrough is small.

(Detailed Description of Components Shown in Tables 1, 2)

TABLE 1

| | | Gas generating composition (mass %) | | | | | Composition of generated gas (ppm) | | | Slag |
|---|---|---|---|---|---|---|---|---|---|---|
| | | GN | BCN | CMCNa | $Al(OH)_3$ | Light rare earth compound - additive | NO | CO | $NH_3$ | state (g) |
| Example | 1 | 41.20 | 49.80 | 5.00 | — | $La(OH)_3$ (4.00) | 200 | 350 | 5 | ○ |
| | 2 | 39.00 | 48.00 | 5.00 | — | $La(OH)_3$ (8.00) | 210 | 300 | 6 | ○ |
| | 3 | 37.00 | 46.00 | 5.00 | — | $La(OH)_3$ (12.00) | 150 | 270 | 11 | ○ |
| | 4 | 42.50 | 50.50 | 5.00 | — | $La(OH)_3$ (2.00) | 80 | 370 | 7 | ○ |
| | 5 | 43.80 | 49.20 | 5.00 | — | $La(NO_3)_3$ (2.00) | 50 | 450 | 6 | ○ |
| | 6 | 44.00 | 47.00 | 5.00 | — | $La(NO_3)_3$ (4.00) | 80 | 410 | 5 | ○ |
| | 7 | 44.50 | 42.50 | 5.00 | — | $La(NO_3)_3$ (8.00) | 55 | 420 | 5 | ○ |
| | 8 | 42.80 | 48.20 | 5.00 | — | $La(OH)_3$ (2.00)/ $La(NO_3)_3$ (2.00) | 50 | 400 | 7 | ○ |
| | 9 | 41.20 | 46.80 | 5.00 | — | $La(OH)_3$ (500)/ $La(NO_3)_3$ (2.00) | 60 | 390 | 4 | ○ |
| | 10 | 41.50 | 44.50 | 5.00 | — | $La(OH)_3$ (5.00)/ $La(NO_3)_3$ (4.00) | 60 | 380 | 6 | ○ |
| | 11 | 31.50 | 41.50 | 5.00 | 4.00 | $La(OH)_3$ (3.00) | 75 | 300 | 5 | Δ |
| | 12 | 36.00 | 45.00 | 5.00 | 4.00 | $La(OH)_3$ (10.00) | 125 | 180 | 7 | Δ |
| | 13 | 31.00 | 41.00 | 5.00 | — | $La(OH)_3$ (8.00)/ Cu (15.00) | 150 | 210 | 9 | ○ |
| | 14 | 34.50 | 43.50 | 5.00 | — | $La(OH)_3$ (12.00)/ Cu (5.00) | 110 | 300 | 13 | ○ |
| | 15 | 41.20 | 49.80 | 5.00 | — | $Nd(OH)_3$ (4.00) | 85 | 400 | 13 | ○ |
| | 16 | 39.00 | 48.00 | 5.00 | — | $Nd(OH)_3$ (8.00) | 65 | 360 | 11 | ○ |
| | 17 | 37.00 | 46.00 | 5.00 | — | $Nd(OH)_3$ (12.00) | 150 | 240 | 8 | ○ |
| Comparative Example | 1 | 40.71 | 49.29 | 5.00 | 5.00 | — | 55 | 340 | 6 | x |
| | 2 | 40.71 | 49.29 | 5.00 | 4.00 | Glass powder(1.00) | 60 | 370 | 11 | x |

$La(OH)_3$: manufactured by Taiyo Koko Co., Ltd., lanthanum hydroxide - 100.

$Nd(OH)_3$: manufactured by Taiyo Koko Co., Ltd., neodymium hydroxide - 98.

$La(NO_3)_3[La(NO_3)_3 \cdot 6H_2O]$: Kohnan Muki Ltd., lanthanum nitrate hexahydrate.

Cu: electrolytic copper powder, manufactured by Nikko Materials Co., Ltd., #6.

Glass powder: phosphate glass [$P_2O_5$ (54 to 56 mass %), $Al_2O_3$ (9 to 11 mass %), $Na_2O$ (19 to 21 mass %), $K_2O$ (14 to 16 mass %), softening point about 400° C.

GN: guanidine nitrate.

BCN: basic copper nitrate.

$CeO_2$: particle size 0.6 μm.

$Nd_2O_3$ particle size 6 μm.

$La_2O_3$: particle size 6 μm.

$Pr_6O_{11}$: particle size 15 μm.

$La(OH)_3$: particle size 1.2 μm.

$Nd(OH)_3$: particle size 1 μm

TABLE 2

| | Gas generating composition (mass %) | | | | | Composition of generated gas (ppm) | | | Slag |
|---|---|---|---|---|---|---|---|---|---|
| | GN | BCN | CMCNa | $Al(OH)_3$ | Light rare earth compound - additive | NO | CO | $NH_3$ | amount (g) |
| Embodiment 18 | 37.00 | 46.00 | 5.00 | — | $La(OH)_3$ (12.00) | 4 | 73 | 33 | 8.55 |
| Embodiment 19 | 34.50 | 43.50 | 5.00 | — | $La(OH)_3$ (12.00)/ Cu (5.00) | 3 | 60 | 29 | 10.33 |
| Comparative Example 3 | 43.22 | 46.78 | 3.00 | 6.00 | Glass powder (1.00) | 7 | 60 | 9 | 2.92 |

As is clear from Tables 1 and 2, with the gas generating composition of the Examples, generation of NO and the like was suppressed, and a solid-lump-like slag was formed. Because the mist thus remained in the form of solid slag, the problems associated with the filter being damaged by the mist and the mist passing through the filter can be resolved. A contribution is also made to the decrease in the weight of gas generator because the thickness or bulk density of the filter can be reduced.

With the gas generating composition of the Comparative Examples, the slag remains in the powdered form. Therefore, the amount of mist that came into contact with the filter and passed therethrough was larger than that in the case of the Examples, provided that the same amount of mist was generated.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A gas generating composition comprising:

a guanidine compound as the fuel;

a basic metal nitrate as the oxidizing agent;

at least one cellulose-type binder selected from the group consisting of carboxymethyl cellulose, carboxymethyl cellulose sodium salt, carboxymethyl cellulose potassium salt, carboxymethyl cellulose ammonium salt, cellulose acetate, cellulose acetate butyrate, methyl cellulose, ethyl cellulose, hydroxyethyl cellulose, ethyhydroxyethyl cellulose, hydroxypropyl cellulose, carboxymethylethyl cellulose and microcrystalline cellulose; and a light rare earth compound selected from the group consisting of a combination of $La(OH)_3$ and $La(NO_3)_3$ and a combination of $La(OH)_3$ and Cu, wherein the content of the rare earth compound in the composition is 0.1 to 20 mass %; and wherein the mean particle size of the light rare earth compound is within a range of 0.5 to 500 μm.

2. The gas generating composition according to claim 1, wherein the mean particle size of the light rare earth compound is within a range of 0.7 to 20 μm.

3. The gas generating composition according to claim 1, wherein the content of the rare earth compound is 0.5 to 10 mass %.

4. The gas generating composition according to claim 1, wherein the mean particle size of the light rare earth compound is within a range of 0.5 to 100 μm.

5. The gas generating composition according to claim 1, wherein the content of the rare earth compound is 0.5 to 15 mass %.

6. The gas generating composition according to claim 1, wherein the fuel is guanidine nitrate.

7. The gas generating composition according to claim 1, wherein the oxidizer is at least one selected from the group consisting of basic copper nitrate, basic cobalt nitrate, basic zinc nitrate, basic manganese nitrate, basic iron nitrate, basic molybdenum nitrate, basic bismuth nitrate and basic cerium nitrate.

8. The gas generating composition according to claim 1, wherein the oxidizer is basic copper nitrate.

* * * * *